United States Patent [19]

Haft

[11] Patent Number: 4,473,914

[45] Date of Patent: Oct. 2, 1984

[54] METHOD AND APPARATUS FOR MANUFACTURING A STOP AND LOCK SHOULDER FOR A BLIND FASTENER SLEEVE

[75] Inventor: Ronald R. Haft, Waco, Tex.

[73] Assignee: Huck Manufacturing Company, Irvine, Calif.

[21] Appl. No.: 431,623

[22] Filed: Sep. 30, 1982

[51] Int. Cl.[3] ..... B21K 1/58

[52] U.S. Cl. ..... 10/11 R; 10/27 R; 411/43; 411/45; 411/70

[58] Field of Search ..... 10/11 R, 27 R, 24; 411/43, 34, 38, 44, 45, 48, 56, 69, 70

[56] References Cited

U.S. PATENT DOCUMENTS

| | | | |
|---|---|---|---|
| 2,538,623 | 1/1951 | Keating | 411/43 |
| 3,073,205 | 1/1963 | Siebol | 411/43 |
| 3,288,016 | 11/1966 | Reynolds | 411/34 |
| 3,292,482 | 12/1966 | Fry et al. | 411/43 |
| 3,501,790 | 3/1970 | Wickers | 10/27 R |
| 4,046,053 | 9/1977 | Alvi et al. | 411/43 |

*Primary Examiner*—Ervin M. Combs
*Assistant Examiner*—Charles Rosenberg
*Attorney, Agent, or Firm*—Harness, Dickey & Pierce

[57] ABSTRACT

A method and apparatus for forming a hollow sleeve for a blind fastener including the steps of forming a sleeve blank to have an enlarged sleeve head and a through bore having a radially inwardly extending shoulder forming portion, deforming the material on the shoulder forming portion to move axially toward the sleeve head and radially inwardly from the reduced diameter bore portion and substantially deforming the material away from the sleeve head and back towards the contour of the reduced diameter bore portion to form a sleeve stop shoulder.

17 Claims, 6 Drawing Figures

METHOD AND APPARATUS FOR MANUFACTURING A STOP AND LOCK SHOULDER FOR A BLIND FASTENER SLEEVE

BACKGROUND AND SUMMARY OF THE INVENTION

The present invention relates to a method and apparatus for manufacturing blind fasteners including a pin and a sleeve and more particularly to a method and apparatus for manufacturing the sleeve to have a stop shoulder adapted to provide material for locking the pin and sleeve together.

The present invention is related to the commonly assigned U.S. patent application Ser. No. 425,304, filed Sept. 28, 1982, by Walter J. Smith for "Two Piece Blind Fastener with Lock Spindle Construction". The disclosure of that application is incorporated herein by reference.

In many blind fastener applications it is desirable that the pin and sleeve be mechanically locked together to inhibit separation and loss of the pin through vibration, etc. Examples of such blind fasteners can be seen in the following U.S. patents: U.S. Pat. No. 4,046,053 for Blind Rivet issued on Sept. 6, 1977 to Alvi et al, U.S. Pat. No. 3,288,016 for Blind Two-Piece Fastener issued on Nov. 29, 1966 to Reynolds, and U.S. Pat. No. 2,538,623 for Rivet Assembly issued on Jan. 16, 1951 to Keating.

In the application of Smith, supra, a two piece blind fastener (including a pin and a sleeve) of simple construction is provided in which an internal portion of the sleeve is folded and/or moved radially inwardly by a portion of the pin into a lock pocket on the pin. The present invention provides a novel method and apparatus for manufacturing a sleeve having an internal portion which can be folded and/or moved radially inwardly into the pin lock pocket. As noted in the Smith application it is desirable that the sleeve portion be formed to include a portion radially separated from the adjacent portion of the sleeve by a taper and/or slit. The present invention provides a novel method and apparatus for constructing such a sleeve portion.

Therefore it is an object of the present invention to provide a novel method and apparatus for manufacturing a blind fastener sleeve having a portion which can be deformed or folded radially inwardly to lock the sleeve with an associated pin.

It is another object of the present invention to provide a novel method and apparatus for providing a lock portion of a blind fastener sleeve which is at least partially radially separated from the adjacent portion of the sleeve.

It is another object of the present invention to provide a novel method and apparatus for providing a lock portion of a blind fastener sleeve which is at least partially radially separated from the adjacent portion of the sleeve by a taper.

It is a general object of the present invention to provide a novel method and apparatus for the manufacture of a blind fastener sleeve.

Other objects, features, and advantages of the present invention will become apparent from the subsequent description and the appended claims, taken in conjunction with the accompanying drawings, in which:

Figure 1:
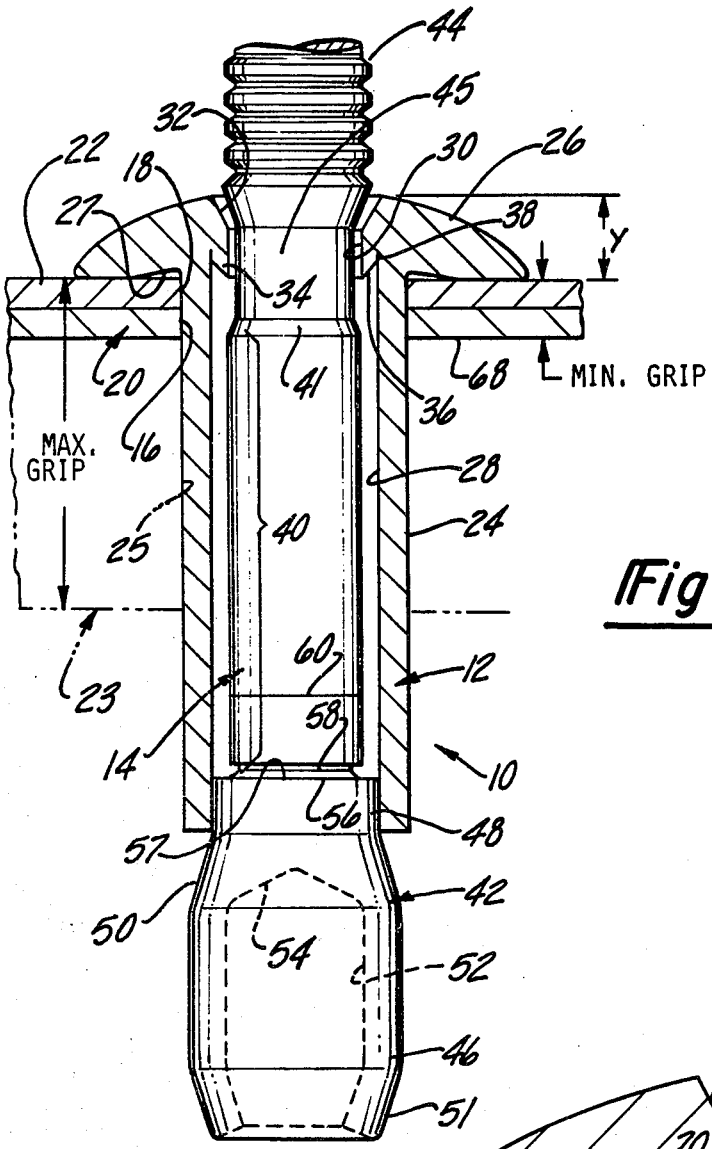
FIG. 1 is an elevational view, with some parts shown in section and others shown broken away, of a blind fastner, including a pin and a sleeve and depicting the lock and stop mechanism on the pin and sleeve, prior to installation, in relationship to a pair of workpieces to be fastened together.

Before looking to the method and apparatus for manufacturing the blind fastener sleeve lock and stop, one form of the blind fastener will be briefly described. Thus looking to FIG. 1, a blind fastener 10, including a hollow sleeve 12 and a pin 14, is shown located in aligned openings 16 and 18, in workpieces 20 and 22, respectively, which are to be joined together. Workpieces 20 and 22 have a combined thickness representing the minimum grip for the fastener 10. The addition of workpiece 23 (with opening 25), shown in phantom, represents the maximum grip for the fastener 10. The thickness of workpiece 23 represents the grip range for fastener 10, i.e. the general maximum range of workpiece thickness in which fastener 10 operates between minimum and maximum grip.

The hollow sleeve 12 has a generally straight shank portion 24 of a uniform outside diameter which terminates at its forward end in an enlarged head 26. The enlarged head 26 has a concave recess 27 adjacent the shank portion 24 to provide clearance with the outer edge of opening 18.

Sleeve 12 has a central through bore which includes a shank bore portion 28 which extends generally for the length of the shank portion 24 and communicates proximate the enlarged head 26 with a reduced diameter bore portion 30 which in turn terminates in a countersunk portion 32. An annular stop shoulder 34 is defined at the juncture of shank bore portion 28 and the reduced diameter bore portion 30.

The stop shoulder 34 terminates in a radially inwardly rearwardly inclined generally frusto-conical surface 36. It can also be seen that the stop shoulder 34 is further separated from the radially confronting portion of the sleeve 12 by an annular slit 38 which extends axially forwardly towards the enlarged head 26.

The pin 14 has an elongated generally smooth pin shank portion 40 which terminates in an enlarged head 42 at its rearward end (the blind end of fastener 10); pin 14 has a plurality of annular pull grooves 44 at the opposite end connected to the shank portion 40 by a smooth, reduced diameter portion 45; a tapered portion 41 connects shank portions 40 and 45. The diameter of pin shank portion 40 is generally the same as that of the reduced diameter bore portion 30 in sleeve 12, while the smooth portion 45 is in substantial clearance with bore portion 30. The maximum or crest diameter of the pull grooves 44, however, is larger than bore portion 30 and thereby holds the sleeve 12 and pin 14 together in a pre-assembled condition prior to installation. The pull grooves 44 are rolled from the same diameter as portion 45 after the pin 14 has been inserted into sleeve 12.

The pin head 42 has an enlarged diameter end portion 46 connected to a reduced diameter portion 48 by a frusto-conical or tapered portion 50. The reduced diameter head portion 48 is of a diameter to fit snugly or with a slight clearance within the shank bore portion 28 of sleeve 12. The pin head 42 is generally hollow by way of a blind bore 52 which terminates in a tapered portion 54 which extends generally into the region of the frusto-conical head portion 50. The end of pin head 46 is partially closed via a frusto-conical portion 51. The outside diameter of the head end portion 46 is generally around that of the outside diameter of the sleeve shank portion 24.

An annular pin stop shoulder 56 is defined by the juncture of the reduced diameter head portion 48 and the pin shank portion 40 and has an end surface 57 which is generally planar and in a plane in quadrature with the longitudinal axis of the pin 14. A lock pocket 58 is defined by an annular groove located immediately adjacent the pin stop 56. Axially forwardly a preselected distance from the lock pocket 58 is an annular breakneck groove 60. The breakneck groove 60 can be generally closed and of a type shown in the U.S. patent to Fry U.S. Pat. No. 3,292,482 and defines the weakest section of the pin 14.

The fastener 10 is adapted to be set by an installation tool which can be of a type well known in the art and hence the details thereof have been omitted for simplicity. However, it should be noted that the tool has a chuck jaw assembly which is adapted to grippingly engage the pull grooves 44 of the pin 14 while an anvil engages the enlarged sleeve head 26. Upon actuation of the tool, the jaw assembly moves axially away from the anvil whereby a relative axial force is applied between the pin 14 and sleeve 12.

As this relative axial force increases in magnitude, the pin 14 is pulled into the sleeve 12 and the tapered head portion 50 is moved into the end of the sleeve 12 to expand that end to form an enlarged, tulip shaped blind head against the blind side surface 68 of workpiece 20.

Figure 2:
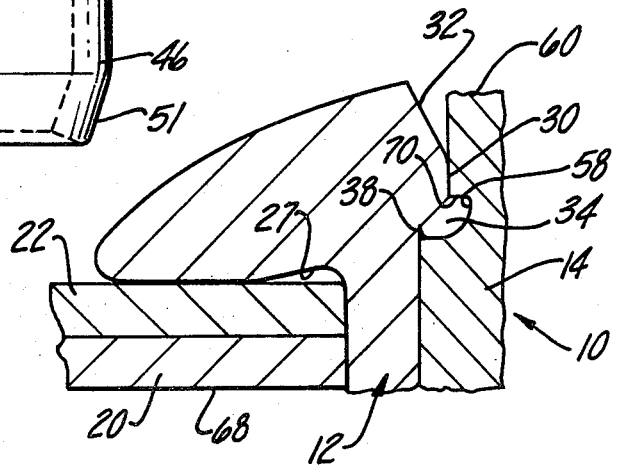
FIG. 2 is a fragmentary view, to enlarged scale, with some parts shown in section of the lock mechanism fully set between the sleeve and pin.

As axial movement of the pin 14 continues the pin stop shoulder surface 57 engages the sleeve stop should surface 36 moving it radially inwardly into the lock pocket 58 (see FIG. 2). The relative axial force applied between the pin 14 and sleeve 12 increases until a force of preselected magnitude is reached at which the pin 14 is fractured at the breakneck groove 60.

Note that the sleeve stop shoulder surface 36 is inclined to assist the material thereof to be folded or moved radially inwardly. Thus during installation the material of sleeve stop shoulder 34 will be substantially directed radially inwardly and not radially outwardly. As previously discussed, the sleeve stop shoulder 34 is annularly separated for a selected distance along the annular slit 38. This slit or separation enhances the radially inward folding action of the material of the sleeve stop shoulder 34 into the lock groove 58. The tapered sleeve surface 36 defines the initial radial separation of the sleeve stop shoulder 34 from the radially confronting portion of the sleeve 12.

The method and apparatus for manufacturing the sleeve stop shoulder 34 as shown in FIGS. 3–6. In the description of the sleeve in process in FIGS. 3–6, components similar to like components of the sleeve 12 of FIGS. 1 and 2 have been given the same numerical designation with the addition of a prime.

Figures 3, 4:
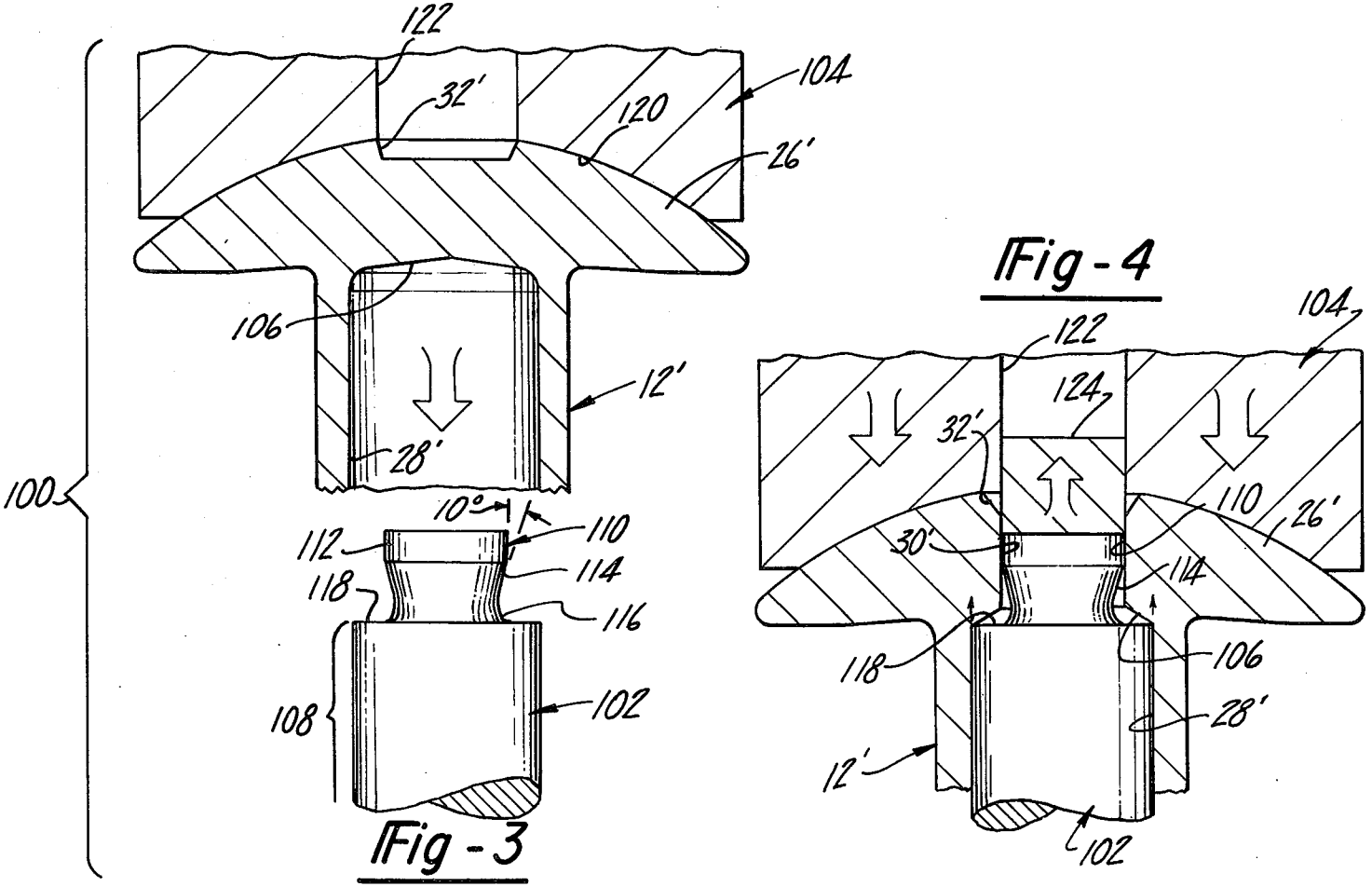
FIGS. 3–6 are fragmentary views of a sleeve blank and apparatus for forming the sleeve lock and stop mechanism on the blank and showing the different steps in the method of forming the same.
Figure 6:
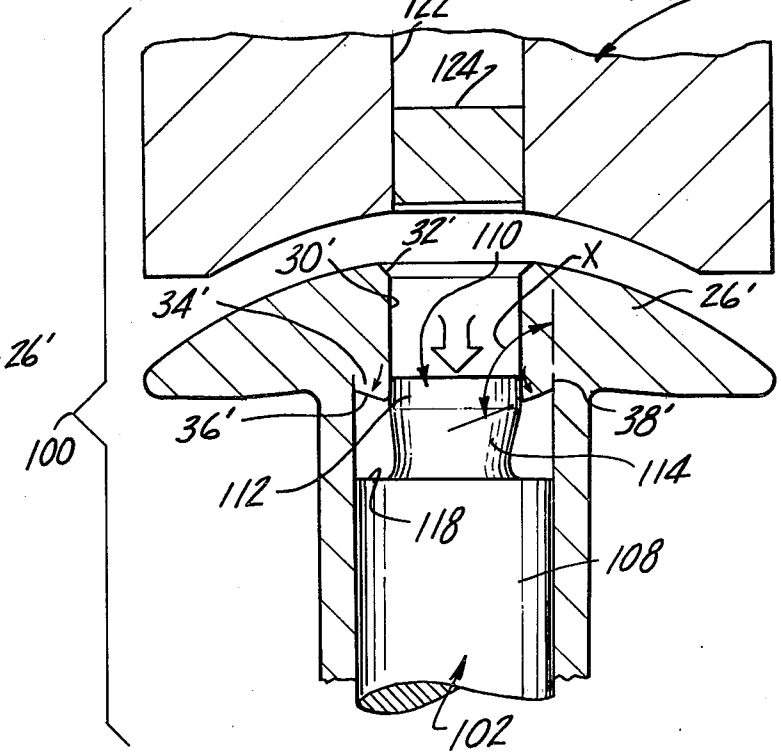

Thus in FIG. 3 a sleeve blank 12' is shown located in a piercing assembly 100 which includes a stationary piercing pin or punch 102 and an associated, movable piercing die 104. At this stage the blank 12' has been essentially formed to the final external configuration of sleeve 12 (see FIGS. 1 and 2) except for the piercing of reduced diameter bore 30 and the formation of the sleeve stop shoulder 34. Note that the sleeve shank bore portion 28' has been essentially formed and terminates generally in the area of the enlarged sleeve head 26' in a conical end surface 106. Note that the conical surface 106 tapers oppositely from that of sleeve shoulder surface 36.

The piercing pin 102 is stationarily mounted and includes a pin shank 108 and a piercing head 110. The shnk 108 is generally of the same diameter as sleeve bore portion 28'.

The piercing head 110 terminates in a piercing land 112 which is generally of a diameter to form the reduced diameter sleeve bore 30 (see FIG. 1). A tapered neck portion 114 extends radially inwardly from the piercing land 112 towards the pin shank 108 and terminates there in a generous radius 116 which blends into a shoulder 118 located at the juncture of the radius 116 and the terminus of the pin shank 108. Note that the shoulder 118 is not inclined but is generally in a plane which is in quadrature with the axis of the pin shank 108.

The sleeve blank 12' is held in the movable die 104 with its head portion 26' supported in a similarly shaped cavity 120. A central bore 122 communicates with the die cavity 120 and is of a diameter to receive the piercing pin shank 108 in a slight clearance relationship. Note that at this point the countersunk bore portion 32' had already been formed in blank 12' and is generally axially aligned with central die bore 122.

Looking now to FIG. 4, the die 104, with sleeve blank 12', has moved relative to the piercing pin 102 such that the pin shank 108 is in the sleeve bore 28'. The piercing head 110 punches out a central slug 124 from the sleeve head 26' moving it through the die bore 122. In this way the reduced diameter sleeve bore 30° is formed.

As the movement of the die 104 (and of sleeve blank 12') continues, the pin shoulder 118 engages the remaining portion of the conical end surface 106 upsetting that material whereby it flows radially inwardly into the cavity defined by the tapered neck portion 114. Thus in FIG. 5, the die 104 has completed its movement towards piercing pin 102 such that the cavity of the tapered neck portion 114 is substantially completely filled. At the same time, the piercing land 112 has moved substantially completely through the sleeve bore 30' whereby the bore 30° has been sized and the slug 124 has been ejected. Note that the material of sleeve blank 12' which is moved into the tapered neck portion 114 is located generally within the confines of the sleeve head 26' whereby radially outward flow of the upset sleeve material is generally inhibited by the stiffness of the head 26'.

Figure 5:
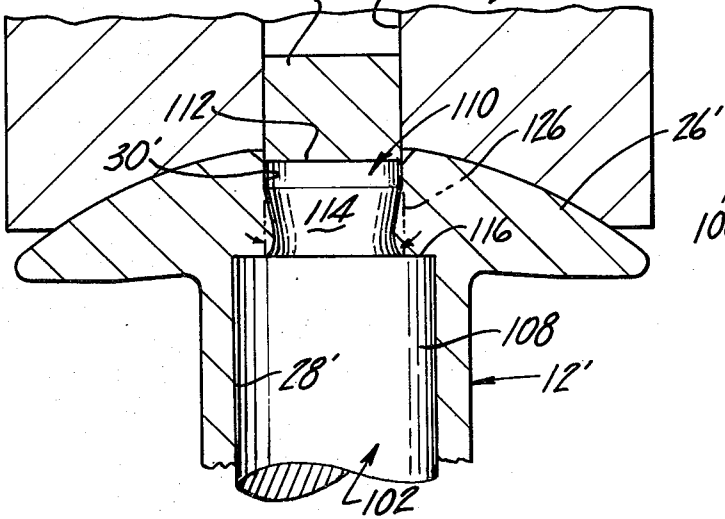

Thus after completion of the piercing and upsetting stroke of FIG. 5 an annulus of material 126 (shown by the phantom lines) is trapped within the cavity defined by the tapered neck portion 114. As the sleeve blank 12' is stripped from the piercing pin 102, the trapped material 126 is moved axially away from the sleeve head 26'; at the same time the taperered surface of neck portion 114 moves or folds the material 126 radially outwardly towards the sleeve bore portion 28'. In one form of the invention a 10 degree taper (see FIG. 3) was found satisfactory. The land 112 as it is removed from the sleeve blank 12' completes the radially outward movement of the material against the sleeve bore 28' and at the same time reforms the reduced diameter bore portion 30' in the area of the displaced material 126.

The result is the formation of the stop and lock shoulder 34' of sleeve 12' which is annularly, radially separated from the adjacent portion of the sleeve 12' by a slit 38'. At the same time the end surface 36' has the desired taper i.e. inclined radially inwardly in a direction away from the sleeve head 26'. Note that the volume of separated material (defined by annulus 126) can be varied by varying the volume of the cavity defined by the tapered neck portion 114. The volume is selected to be greater than that required to fill the lock pocket 58.

It should be noted that the angle of inclination of the sleeve stop shoulder 34' can be selectively varied by modifying the angle of the taper of tapered neck portion 114. For example, an increase in the angle of taper of neck portion 114 from the 10 degree angle shown in FIG. 3 would reuslt in an increase in the angle of inclination of the stop shoulder 34',i.e. the obtuse angle X between surface 36' and axial slit 38', see FIG. 6.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. For a two piece blind fastener for securing a plurality of workpieces comprising a hollow sleeve having a through bore, the sleeve having a sleeve shank portion and an enlarged sleeve head at one end, a pin, the pin having a shank portion and an enlarged pin head with the pin shank portion adapted to be located within the bore of the sleeve and with the pin head located at the end of the sleeve shank portion opposite the sleeve head, the through bore of the sleeve having a reduced diameter bore portion defining a radially inwardly extending sleeve stop shoulder, the pin having a pin stop shoulder, a lock groove located on the pin, the pin head adapted to engage the sleeve shank portion and to deform the same to form a blind head opposite the sleeve head in response to a relative axial force applied between the pin and the sleeve, the sleeve stop shoulder having at least a portion thereof radially separated from the radially confronting portion of the sleeve, the pin stop shoulder adapted to engage the sleeve stop shoulder for directing the material of the sleeve stop shoulder radially inwardly into the lock groove to lock the pin and sleeve together, the method of forming the sleeve stop shoulder including the steps of forming a sleeve blank to have the enlarged sleeve head and to have the through bore and reduced diameter bore portion with the juncture therebetween defining a radially inwardly extending shoulder forming portion, a first deforming step to deform the material of said shoulder forming portion to move axially toward the sleeve head and radially inwardly from the reduced diameter bore portion, and a second deforming step to deform the material away from the sleeve head and back towards the contour of the reduced diameter bore portion to form the sleeve stop shoulder with at least a portion radially separated from the radially confronting portion of the sleeve.

2. The method of claim 1 with the second deforming step deforming the material to form a surface on the sleeve stop shoulder which tapers radially inwardly in an axial direction away from the sleeve head.

3. The method of claim 1 with the second deforming step deforming the material to form the sleeve stop shoulder to have a slit separating at least a portion of said stop shoulder in a direction extending axially toward the sleeve head.

4. The method of claim 1 with the reduced diameter bore portion being formed generally simultaneously with the formation of the sleeve stop shoulder.

5. The method of claim 1 with the reduced diameter bore portion being formed during said first deforming step and being reformed to size with said second deforming step.

6. The method of claim 1 with the material of said shoulder forming portion being located substantially within the confines of the sleeve head.

7. For a two piece blind fastener for securing a plurality of workpieces comprising a hollow sleeve having a through bore, the sleeve having a sleeve shank portion and an enlarged sleeve head at one end.

a pin, the pin having a shank portion and an enlarged pin head with the pin shank portion adapted to be located within the bore of the sleeve and with the pin head located at the end of the sleeve shank portion opposite the sleeve head, the through bore of the sleeve having a reduced diameter bore portion defining a radially inwardly extending sleeve stop shoulder, the pin having a pin stop shoulder, a lock groove located on the pin, the pin head adapted to engage the sleeve shank portion and to deform the same to form a blind head opposite the sleeve head in response to a relative axial force applied between the pin and the sleeve, the sleeve stop shoulder having at least a portion thereof radially separated from the radially confronting portion of the sleeve, the pin stop shoulder adapted to engage the sleeve stop shoulder for directing the material of the sleeve stop shoulder radially inwardly into the lock groove to lock the pin and sleeve together, the method of forming the sleeve stop shoulder including the steps of forming a sleeve blank to have the enlarged sleeve head and to have the through bore and reduced diameter bore portion with the juncture therebetween defining a radially inwardly extending shoulder forming portion, providing a piercing pin to have an enlarged shoulder portion, a forming land and a tapered portion located between the shoulder portion and the forming land, the enlarged shoulder portion being of a diameter generally that of the sleeve through bore and the forming land being of a diameter generally that of the reduced diameter bore portion and with the tapered portion defining a cavity between the enlarged shoulder and forming land, moving the piercing pin into the through bore of the sleeve blank and engaging the sleeve shoulder forming portion with the enlarged shoulder to deform the material of the sleeve shoulder forming portion radially inwardly into the cavity of the tapered portion, removing the piercing pin from the sleeve blank while deforming the material in the cavity of the tapered portion radially outwardly to form the sleeve stop shoulder with at least a portion radially separated from the radially confronting portion of the sleeve.

8. The method of claim 7 with the removal step deforming the material to form a surface on the sleeve stop shoulder which tapers radially inwardly in an axial direction away from the sleeve head.

9. The method of claim 7 with the removal step deforming the material to form the sleeve stop shoulder to have a slit separating at least a portion of said stop shoulder in a direction extending axially toward the sleeve head.

10. The method of claim 7 with the piercing pin having a piercing land for forming the reduced diameter bore portion generally simultaneously with the formation of the sleeve stop shoulder.

11. The method of claim 7 with the piercing pin having a piercing land for forming the reduced diameter bore portion during the step of moving the piercing pin through the through bore and for reforming the reduced diameter portion to size on the removal step.

12. The method of claim 7 with the material of said shoulder forming portion being located substantially within the confines of the sleeve head.

13. For a two piece blind fastener for securing a plurality of workpieces comprising a hollow sleeve having a through bore, the sleeve having a sleeve shank portion and an enlarged sleeve head at one end, a pin, the pin having a shank portion and an enlarged pin head with the pin shank portion adapted to be located within the bore of the sleeve and with the pin head located at the end of the sleeve shank portion opposite the sleeve head, the through bore of the sleeve having a reduced diameter bore portion defining a radially inwardly extending sleeve stop shoulder, the pin having a pin stop shoulder, a lock groove located on the pin, the pin head adapted to engage the sleeve shank portion and to deform the same to form a blind head opposite the sleeve head in response to a relative axial force applied between the pin and the sleeve, the sleeve stop shoulder having at least a portion thereof radially separated from the radially confronting portion of the sleeve, the pin stop shoulder adapted to engage the sleeve stop shoulder for directing the material of the sleeve stop shoulder radially inwardly into the lock groove to lock the pin and sleeve together, apparatus for forming the sleeve stop shoulder comprising a piercing pin having an enlarged shoulder portion, a forming land and a tapered portion located between said shoulder portion and said forming land, said enlarged shoulder portion being of a diameter generally of the sleeve through bore, said forming land being of a diameter generally that of the reduced diameter bore portion, said tapered portion defining a cavity having a preselected volume generally equal to that of the radially separated portion of the sleeve stop shoulder.

14. The apparatus of claim 13 with said forming land adapted for forming a reduced diameter bore portion, said shoulder portion adapted to deform the material of the sleeve radially inwardly to generally fill the cavity of said tapered portion, said forming land adapted to reform the deformed material into the reduced diameter bore portion.

15. The apparatus of claim 13 with said tapered portion having a first preselected angle of inclination selected to provide the desired angle of inclination of the sleeve stop shoulder.

16. The method of claim 2 with the step comprising deforming the material along a tapered surface having a preselected angle of inclination to form the sleeve stop shoulder to have a desired taper angle.

17. The method of claim 7 comprising providing the tapered portion of the piercing pin to have a first preselected angle of inclination selected to provide the desired taper angle on the sleeve stop shoulder.

* * * * *

UNITED STATES PATENT AND TRADEMARK OFFICE

CERTIFICATE OF CORRECTION

PATENT NO. : 4,473,914

DATED : October 2, 1984

INVENTOR(S) : Ronald R. Haft

It is certified that error appears in the above-identified patent and that said Letters Patent is hereby corrected as shown below:

Column 1, line 68 delete "fastner" and substitute therefor --fastener--.
Column 3, line 36, delete "should" and substitute therefor --shoulder--.
Column 4, line 8, delete "shnk" and substitute therefor --shank--.
Column 4, line 34, delete "30°" and substitute therefor —30'--.
Column 4, 47, delete "30°" second occurrence and substitute therefor --30'--.
Column 5, line 16, delete "reuslt" and substitute therefor --result--.

Signed and Sealed this

*Twenty-sixth* Day of *March 1985*

[SEAL]

*Attest:*

DONALD J. QUIGG

*Attesting Officer* *Acting Commissioner of Patents and Trademarks*